US011443934B2

(12) United States Patent
Kudo

(10) Patent No.: US 11,443,934 B2
(45) Date of Patent: Sep. 13, 2022

(54) TIME-OF-FLIGHT MASS SPECTROMETRY DEVICE

(71) Applicant: SHIMADZU CORPORATION, Kyoto (JP)

(72) Inventor: Tomoya Kudo, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/056,444

(22) PCT Filed: May 23, 2018

(86) PCT No.: PCT/JP2018/019854
§ 371 (c)(1),
(2) Date: Nov. 18, 2020

(87) PCT Pub. No.: WO2019/224948
PCT Pub. Date: Nov. 28, 2019

(65) Prior Publication Data

US 2021/0210327 A1 Jul. 8, 2021

(51) Int. Cl.
*H01J 49/40* (2006.01)
*H01J 49/04* (2006.01)

(52) U.S. Cl.
CPC ..... *H01J 49/401* (2013.01); *H01J 49/0409* (2013.01); *H01J 49/0486* (2013.01)

(58) Field of Classification Search
CPC .. H01J 49/401; H01J 49/0486; H01J 49/0409; H01J 49/24
See application file for complete search history.

(56) References Cited

U.S. PATENT DOCUMENTS 5,593,123 A 1/1997 Crawford
5,756,994 A * 5/1998 Bajic ..... H01J 49/165 250/288
6,700,118 B2 * 3/2004 Yefchak ..... H01J 49/40 250/282
9,269,554 B2 2/2016 Brown et al.
9,698,000 B2 * 7/2017 Liepert ..... H01J 49/24
(Continued)

FOREIGN PATENT DOCUMENTS

JP 2012-064437 A 3/2012
WO 2014/194172 A2 12/2014

OTHER PUBLICATIONS

International Search Report of PCT/JP2018/019854 dated Jul. 24, 2018 [PCT/ISA/210].
(Continued)

*Primary Examiner* — Wyatt A Stoffa
(74) *Attorney, Agent, or Firm* — Sughrue Mion, PLLC

(57) ABSTRACT

A time-of-flight mass spectrometry device includes: an ion introduction unit; a vacuum chamber connected to the ion introduction unit; a support member provided inside the vacuum chamber; a flight tube having a part of the outer surface supported by the support member and provided inside the vacuum chamber; a temperature sensor provided in the vicinity of a connection portion with the support member of the vacuum chamber; a temperature adjustment element provided in the vicinity of the connection portion; and a temperature control unit that controls the temperature adjustment element based on a measurement result of the temperature sensor.

13 Claims, 3 Drawing Sheets

(56) References Cited

U.S. PATENT DOCUMENTS

| | | | | |
|---|---|---|---|---|
| 10,262,848 | B2 * | 4/2019 | Shimomura | H01J 49/0422 |
| 10,438,781 | B2 * | 10/2019 | Yamaguchi | H01J 49/0009 |
| 10,847,356 | B2 * | 11/2020 | Murthy | H01J 49/022 |
| 10,991,566 | B2 * | 4/2021 | Kudo | H01J 49/40 |
| 2003/0034448 | A1 * | 2/2003 | Yefchak | H01J 49/40 250/252.1 |
| 2008/0087810 | A1 * | 4/2008 | Gabeler | H01J 49/40 250/282 |
| 2008/0091370 | A1 * | 4/2008 | Gabeler | H01J 49/0009 702/85 |
| 2010/0019140 | A1 * | 1/2010 | Amirav | H01J 49/049 250/288 |
| 2010/0176292 | A1 * | 7/2010 | Yamauchi | G01N 27/62 250/287 |
| 2012/0068064 | A1 * | 3/2012 | Numata | H01J 49/40 250/287 |
| 2015/0014524 | A1 * | 1/2015 | Chiappetta | H01J 49/40 250/428 |
| 2015/0155149 | A1 * | 6/2015 | Brown | H01J 49/0031 250/288 |
| 2016/0365235 | A1 * | 12/2016 | Chiappetta | H01J 49/24 |

OTHER PUBLICATIONS

Written Opinion of PCT/JP2018/019854 dated Jul. 24, 2018 [PCT/ISA/237].
Partial Supplementary Search Report dated Dec. 16, 2021 in European Application No. 18919667.8.
Extended European Search Report dated Apr. 11, 2022 in Application No. 18919667.8.

* cited by examiner

TIME-OF-FLIGHT MASS SPECTROMETRY DEVICE

CROSS REFERENCE TO RELATED APPLICATIONS

This application is a National Stage of International Application No. PCT/JP2018/019854, filed May 23, 2018.

TECHNICAL FIELD

The present invention relates to a time-of-flight mass spectrometry device.

BACKGROUND ART

In a time-of-flight mass spectrometry device (hereinafter, also referred to as TOFMS), a certain kinetic energy is applied to ions to be analyzed, and the ions are introduced into a flight space being formed in a flight tube to fly in the flight space. Then, the time required for each ion to fly a certain distance is measured, and the mass-to-charge ratio (m/z) of each ion is calculated based on the time of flight. Therefore, if the flight tube expands or contracts due to temperature change, the flight distance of the ions changes, and the flight time also changes, causing an error in the measured value of the mass-to-charge ratio.

In order to avoid a measurement error caused by expansion and contraction of the flight tube due to temperature fluctuation and achieve high measurement accuracy, it has been proposed to install the flight tube in a thermostatic chamber (see Patent Literature 1 (PTL 1)).

CITATION LIST

Patent Literature

PTL 1: Japanese Laid-Open Patent Publication No. 2012-64437

SUMMARY OF INVENTION

Technical Problem

An ion source such as an electrospray ionization source (ESI) using a heated gas is used for the time-of-flight mass spectrometry device. Moreover, a capillary or an orifice, which is a vacuum partition for introducing ions generated by the ion source into a vacuum, is often heated for the purpose of promoting desolvation. In such case, the ion source and the capillary or orifice of the vacuum partition serve as heat sources. The heat generated in such a heat source is conducted through a structure that constitutes an ion path from the heat source to the flight tube, and is transmitted to the flight tube. The heat generation state of the ion source and the heating capillary fluctuates depending on operating conditions such as temperature conditions set according to the measurement conditions. Therefore, the temperature change of the flight tube due to the temperature change of the ion source and the heating capillary cannot be completely prevented and there was a problem that the expansion and contraction of the flight tube cannot be completely prevented only by installing the flight tube in the thermostatic chamber.

Further, an ambient temperature change of the device propagates through the heat conduction path via the device housing to the flight tube and causes the temperature change of the flight tube. Because this temperature change is conducted to the flight tube through a support member or the like that supports the flight tube in a vacuum chamber, even if the flight tube is placed in the thermostatic chamber, the temperature change of the flight tube due to the ambient temperature change of the device cannot be completely avoided, and there was a problem that the expansion and contraction of the flight tube cannot be completely prevented.

In the time-of-flight mass spectrometry device, various power supplies that can serve as heat sources are arranged in the device housing, and some power supplies are sometimes in direct contact with the vacuum chamber. The heat derived from such power supplies propagates through the structure that constitutes the path from the power supplies to the flight tube and is transmitted to the flight tube. The amount of heat generated by the power supply varies depending on operating conditions such as analysis conditions. Therefore, simply installing the flight tube in the thermostatic chamber cannot completely prevent the temperature change of the flight tube due to the change in the heat generation amount of the power supply, and thus, there was a problem that it is impossible to completely prevent the expansion and contraction of the flight tube.

Solution to Problem

According to the 1st aspect of the present invention, a time-of-flight mass spectrometry device comprises: an ion introduction unit; a vacuum chamber connected to the ion introduction unit; a support member provided inside the vacuum chamber; a flight tube having a part of the outer surface supported by the support member and provided inside the vacuum chamber; a temperature sensor provided in the vicinity of a connection portion with the support member of the vacuum chamber; a temperature adjustment element provided in the vicinity of the connection portion; and a temperature control unit that controls the temperature adjustment element based on a measurement result of the temperature sensor.

According to the 2nd aspect of the present invention, the time-of-flight mass spectrometry device is in the time-of-flight mass spectrometry device according to the 1st aspect, and it is preferable that the time-of-flight mass spectrometry device comprises a plurality of the support members, wherein: the temperature sensor and the temperature adjustment element are provided in the vicinity of a plurality of the connection portions connected to the support members in the vacuum chamber.

According to the 3rd aspect of the present invention, the time-of-flight mass spectrometry device is in the time-of-flight mass spectrometry device according to the 2nd aspect, and it is preferable that a plurality of the support members are arranged on a plane orthogonal to the longitudinal direction of the flight tube or in the vicinity of the plane.

According to the 4th aspect of the present invention, the time-of-flight mass spectrometry device is in the time-of-flight mass spectrometry device according to the 3rd aspect, and it is preferable that the time-of-flight mass spectrometry device further comprises: a second temperature sensor and a second temperature adjustment element provided on the outer surface of the vacuum chamber and at positions separated at least in the longitudinal direction of the flight tube from the temperature sensor, wherein: the temperature control unit controls the second temperature adjustment element based on a measurement result of the second temperature sensor.

According to the 5th aspect of the present invention, the time-of-flight mass spectrometry device is in the time-of-flight mass spectrometry device according to the 4th aspect, and it is preferable that the time-of-flight mass spectrometry device further comprises: a third temperature sensor and a third temperature adjustment element provided on the outer surface of the vacuum chamber and at positions separated at least in the longitudinal direction of the flight tube from the second temperature sensor, wherein the temperature control unit controls the third temperature adjustment element based on a measurement result of the third temperature sensor.

According to the 6th aspect of the present invention, the time-of-flight mass spectrometry device is in the time-of-flight mass spectrometry device according to any one of the 1st to 5th aspect, and it is preferable that an inner wall surface of the vacuum chamber facing the flight tube is subjected to radiation factor improvement treatment.

According to the 7th aspect of the present invention, the time-of-flight mass spectrometry device is in the time-of-flight mass spectrometry device according to the 6th aspect, and it is preferable that the ion introduction unit has a contact portion with a device housing, and the ion introduction unit is in thermal contact with the device housing via a high thermal conductive member at at least a part of the contact portion.

According to the 8th aspect of the present invention, the time-of-flight mass spectrometry device is in the time-of-flight mass spectrometry device according to any one of the 1st to 5th aspect, and it is preferable that the ion introduction unit has a contact portion with a device housing, and the ion introduction unit is in thermal contact with the device housing via a high thermal conductive member at at least a part of the contact portion.

According to the 9th aspect of the present invention, the time-of-flight mass spectrometry device is in the time-of-flight mass spectrometry device according to the 8th aspect, and it is preferable that the contact portions are a plurality of locations having different distances from the flight tube, and the high thermal conductive member is provided on a contact portion among a plurality of the contact portions that is far from the flight tube.

According to the 10th aspect of the present invention, the time-of-flight mass spectrometry device is in the time-of-flight mass spectrometry device according to any one of the 1st to 5th aspect, and it is preferable that the vacuum chamber has a second contact portion that contacts with the device housing, and the vacuum chamber is in thermal contact with a device housing via a low heat conductive member at at least a part of the second contact portion.

According to the 11th aspect of the present invention, the time-of-flight mass spectrometry device is in the time-of-flight mass spectrometry device according to the 6th aspect, and it is preferable that the vacuum chamber has a second contact portion that contacts with the device housing, and the vacuum chamber is in thermal contact with a device housing via a low heat conductive member at at least a part of the second contact portion.

According to the 12th aspect of the present invention, the time-of-flight mass spectrometry device is in the time-of-flight mass spectrometry device according to the 7th aspect, and it is preferable that the vacuum chamber has a second contact portion that contacts with the device housing, and the vacuum chamber is in thermal contact with the device housing via a low heat conductive member at at least a part of the second contact portion.

According to the 13th aspect of the present invention, the time-of-flight mass spectrometry device is in the time-of-flight mass spectrometry device according to the 8th aspect, and it is preferable that the vacuum chamber has a second contact portion that contacts with the device housing, and the vacuum chamber is in thermal contact with the device housing via a low heat conductive member at at least a part of the second contact portion.

Advantageous Effects of Invention

According to the present invention, it is possible to prevent temperature change of the flight tube and expansion and contraction thereof due to the temperature change, and it is possible to realize a time-of-flight mass spectrometry device with high measurement accuracy.

DESCRIPTION OF EMBODIMENTS

One Embodiment of Time-of-flight Mass Spectrometry Device

Figure 1:
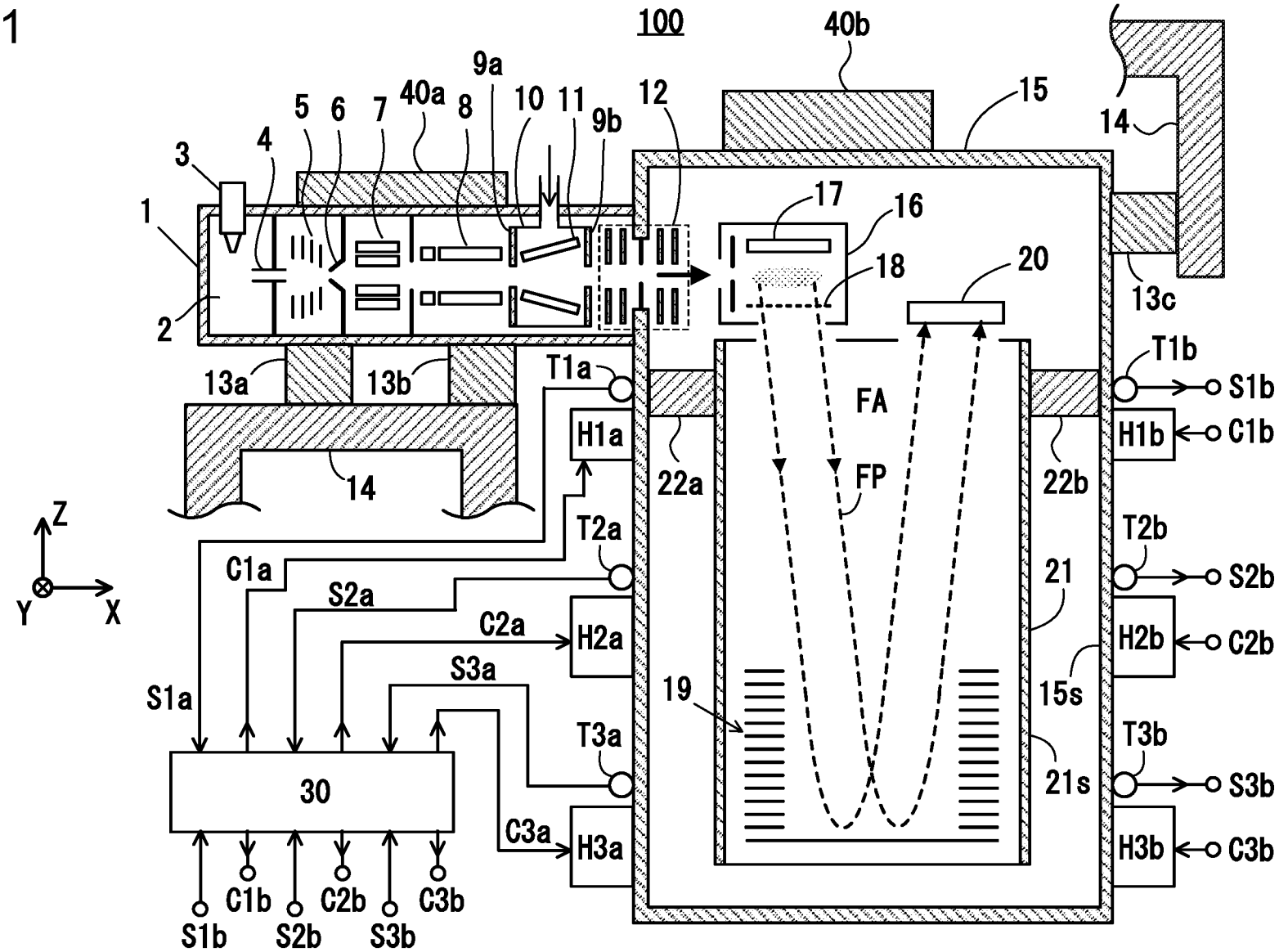
FIG. 1 is a schematic diagram showing a configuration of a time-of-flight mass spectrometry device according to one embodiment.

FIG. 1 is a schematic diagram showing a configuration of a time-of-flight mass spectrometry device 100 according to the present embodiment. The time-of-flight mass spectrometry device 100 includes an ion introduction unit 1, a vacuum chamber 15 connected to the ion introduction unit 1, and a flight tube 21 provided inside the vacuum chamber 15.

An ionization chamber 2 in the ion introduction unit 1 is provided with an ESI spray 3, as an ion source, for performing electrospray ionization (ESI). Upon supplying a sample liquid containing components to be analyzed to the ESI spray 3, the sample liquid is electrostatically sprayed from the ESI spray 3 to generate ions derived from the sample in the sample liquid. It is to be noted that the ionization method is not limited to this. However, whichever ionization method is adopted, the ion source is a heat source, and its temperature fluctuates depending on the operating state.

Generated various ions pass through a heating capillary 4, are converged by an ion guide 5 and reach an octapole type ion guide 7 through a skimmer 6. The ions converged by the ion guide 7 are introduced into a quadrupole mass filter 8, and only the ions having a specific mass-to-charge ratio according to the voltage applied to the quadrupole mass filter 8 pass through the quadrupole mass filter 8. These ions are introduced into a collision cell 10 as precursor ions, then the precursor ions are dissociated by collision with CID gas supplied into the collision cell 10 from outside of the collision cell 10, and various product ions are generated.

A multi-pole ion guide 11 in the collision cell 10 functions as a kind of linear ion trap together with an inlet lens electrode 9*a* and an exit lens electrode 9*b*, and the generated product ions are temporarily accumulated. Then, the accumulated ions are discharged from the collision cell 10 at a predetermined timing, guided by an ion transport optical system 12, and introduced into the vacuum chamber 15 connected to the ion introduction unit 1.

Although not shown, a vacuum pump is connected to the ion introduction unit 1 and the vacuum chamber 15, and the insides thereof are kept in a depressurized state.

Inside the vacuum chamber 15, support members 22*a* and 22*b* (22*a* and 22*b* are collectively referred to as a support member 22) having insulating properties and high vibration absorption performance are provided. At least a part of the outer surface of the flight tube 21 having a substantially square tube shape or a substantially cylindrical shape is supported by the support member 22, and is supported by the vacuum chamber 15 via the support member 22.

Moreover, an orthogonal acceleration unit 16 and an ion detector 20 are respectively fixed to the flight tube 21 via support members (not shown). A reflector 19 composed of a number of annular or rectangular reflective electrodes is arranged at the lower side of the inside of the flight tube 21. Thereby, a reflectron-type flight space FA in which ions are folded back by a reflective electric field formed by the reflector is provided inside the flight tube 21.

The flight tube 21 is made of metal such as stainless steel, and a predetermined DC voltage is applied to the flight tube 21. To the plurality of reflective electrodes constituting the reflector, different DC voltages are respectively applied based on the voltage applied to the flight tube 21. Thereby, the reflective electric field is formed in the reflector, and flight space FA other than the reflective electric field has no electric field and no magnetic field and in a high vacuum.

By being formed a predetermined electric field between an extrusion electrode 17 and an extraction electrode 18 at a predetermined timing, the ions traveling in the +X direction and introduced into the orthogonal acceleration unit 16 are accelerated in the −Z direction to start flying. As shown in broken line flight paths FP, the ions emitted from the orthogonal acceleration unit 16 first fly freely in the flight space FA, and then are turned back to the +Z direction by the reflective electric field formed by the reflector 19 and again fly freely in the flight space FA to reach the ion detector 20. The velocity of an ion in the flight space depends on the mass-to-charge ratio of the ion. Therefore, ions having different mass-to-charge ratios introduced into the flight space FA at substantially the same time are separated according to respective mass-to-charge ratio during flight and reach the ion detector 20 with time lag. A detection signal by the ion detector 20 is input to a signal processing unit (not shown), and the flight time of each ion is converted into a mass-to-charge ratio to create a mass spectrum and perform mass spectrometry.

If the flight tube 21 expands due to heat, the flight distance changes, which causes an error in the measured value of the mass-to-charge ratio. Therefore, in the TOFMS according to the present embodiment, the flight tube 21 is provided inside the vacuum chamber 15 via the support member 22, and temperature adjustment elements H1*a* and H1*b* are provided on the vacuum chamber 15 in the vicinity of the connection portion with the support member 22.

More specifically, as shown in FIG. 1, support members 22*a* and 22*b* for supporting the flight tube 21 are provided inside the vacuum chamber 15, and the support members 22 partially hold a side of the flight tube 21 close to the orthogonal acceleration portion 16 and the ion detector 20.

Of the vacuum chamber 15, temperature sensors T1*a* and T1*b* are provided in the vicinity of the connecting portion to which the support member 22 is connected. The temperatures of the vacuum chamber 15 and the support members 22*a* and 22*b* in the vicinity of the connection portion are measured by the temperature sensors T1*a* and T1*b*, and temperature measurement results are transmitted to a temperature control unit 30 as a temperature measurement signal S1*a* and a temperature measurement signal S1*b*.

Of the vacuum chamber 15, the temperature adjustment elements H1*a* and H1*b* such as an electric heaters are provided in the vicinity of the connection portion to which the support member 22 is connected, and the temperature of the connecting portion to which the support member 22 is connected is controlled to a predetermined temperature of, for example, 35° C. or higher and 50° C. or lower based on the temperature control signals C1*a* and C1*b* from the temperature control unit 30.

Figure 2:
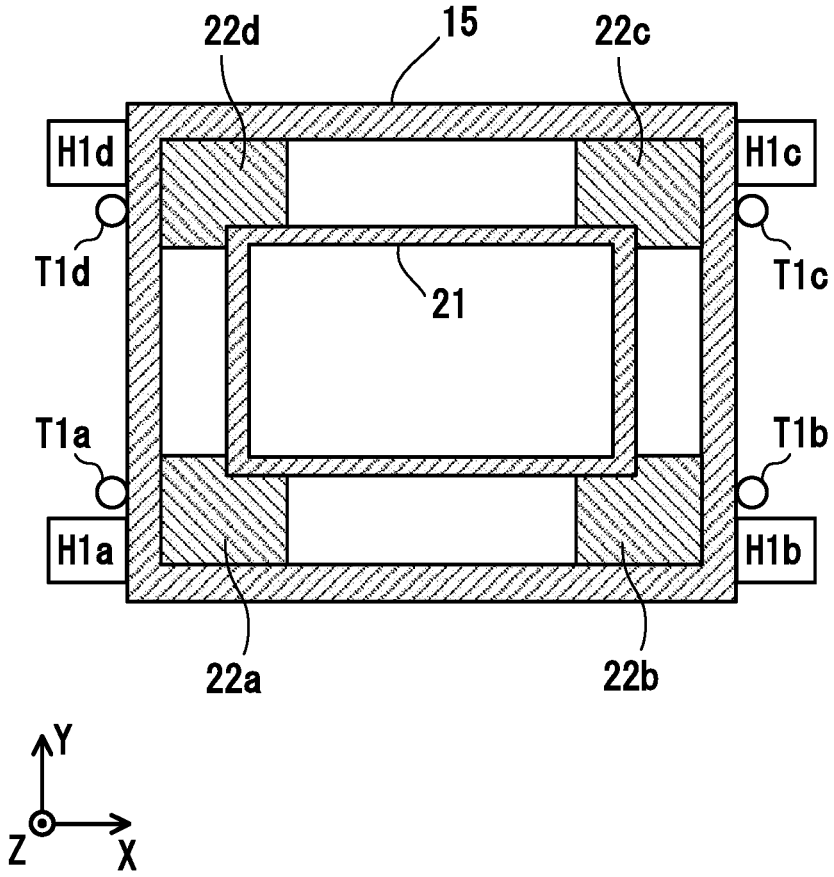
FIG. 2 is a schematic view showing a vicinity of a support member that supports a flight tube in a time-of-flight mass spectrometry device according to one embodiment.

FIG. 2 shows a sectional view of the vacuum chamber 15, the flight tube 21, and the support member 22 in the XY plane of FIG. 1, at the portion where the support member 22 is provided.

At each of four corners of the inner surface of the vacuum chamber 15 having a quadrangular cross-sectional shape in the XY plane, support members 22*a* to 22*d* are provided respectively and support the flight tube 21 having a quadrangular cross-sectional shape in the XY plane. In other words, the plurality of support members 22*a* and 22*b* are arranged on or near a plane (XY plane in FIG. 1) orthogonal to the longitudinal direction (Z direction in FIG. 1) of the flight tube 21. By arranging the plurality of support members 22*a* and 22*b* at substantially the same positions in the longitudinal direction of the flight tube 21 in this way, the flight tube 21 can be held while preventing deformation.

On the outer surface of the vacuum chamber 15 and in the vicinity of the connecting portions connecting the support members 22*a* to 22*d* and the vacuum chamber 15, temperature sensors T1*a* to T1*d* and temperature adjustment elements H1*a* to H1*d* are provided respectively. The temperature measurement results by the temperature sensors T1*c* and T1*d*, which are omitted in FIG. 1, are also transmitted to the temperature control unit 30, and the temperature control unit 30 transmits the temperature control signals to the temperature adjustment elements H1*c* and H1*d*.

Hereinafter, the temperature sensors T1*a* to T1*d* may be referred to as a temperature sensor T1 in combining them or any one of them. Further, the temperature adjustment elements H1*a* to H1*d* may be referred to as a temperature adjustment element H1 in combining them or any one of them.

Mounting positions of the support members 22*a* to 22*d* are not limited to the four corners of the XY cross section of the vacuum chamber 15 as shown in FIG. 2, and an arbitrary number of the support members may be provided at an arbitrary number of positions such as another four positions, 6 positions, or 5 positions.

Alternatively, the support member 22 may be a continuous member surrounding the flight tube 21. Even in this case, a plurality of the temperature sensors T1 and the temperature adjustment elements H1 can be arranged in the vicinity of the connection portion between the continuous support member 22 and the vacuum chamber 15 in the same manner as described above. Alternatively, only one temperature sensor T1 and only one temperature adjustment element H1 may be arranged.

By arranging a plurality of temperature sensors T1 and temperature adjustment elements H1, the temperature distribution of the vacuum chamber 15 and the flight tube 21 in the XY plane in FIG. 1 can be made more uniform. For example, of the vacuum chamber 15, the flight tube 21, and the support member 22, the side closer to the ion introduction unit 1 is susceptible to heat fluctuations from the ion introduction unit 1, and therefore temperature fluctuations are likely to occur. However, by arranging a plurality of the temperature sensors T1 and the temperature adjustment elements H1, temperature non-uniformity caused by being near or far with respect to the ion introduction unit 1 can also be measured and corrected.

In this case, it is preferable that the temperature control unit 30 independently controls the temperature adjustment elements H1*a* to H1*d* based on the measurement results of the temperature sensors T1*a* to T1*d*.

Alternatively, in the control of the temperature adjustment elements H1*a* to H1*d*, among the temperature sensors T1*a* to T1*d*, the measurement result of the closest temperature sensor may be multiplied by the maximum weight, and the measurement results of other temperature sensors may also be multiplied by certain weight.

It is to be noted, it is also possible to control the plurality of temperature adjustment elements H1a to H1d by using representative values such as average value or median value of the measurement results of the plurality of temperature sensors T1*a* to T1*d*.

In case the support member 22 is separated into a plurality of parts as in the example of FIG. 2, it is preferable that the temperature sensor T1 and the temperature control portion H1 are provided in each of plurality of connection portions joined with the vacuum chamber 15.

However, in the two connection portions arranged relatively close to each other, since the two support members 22 to be measured and to be temperature controlled are to be closed to each other, at least one of the temperature sensor T1 and the temperature adjustment element H1 can be omitted without arrangement. Thus, the number of the temperature sensors T1 and the temperature adjustment element H1 may be smaller than the number of the support members 22, respectively.

It is desirable that the temperature sensor T1 and the temperature adjustment element H1 are both installed within 100 mm of distance (closest contact distance between the two) from the connection portion of the respective support member 22 and the vacuum chamber 15.

If the installation position of the temperature sensor T1 is more than 100 mm from the connection portion, it becomes difficult to accurately measure the temperature of the connection portion and the support member 22, and the temperature change of the flight tube 21 may occur.

Moreover, if the installation position of the temperature adjustment element H1 is more than 100 mm from the connection portion, it becomes difficult to accurately control the temperature of the connection portion and the support member 22, and the temperature change of the flight tube 21 may occur.

In order to control the temperature of the flight tube 21 with higher accuracy, it is more preferable that the installation positions of the temperature sensor T1 and the temperature adjustment element H1 should both be within 60 mm from the connection portion of the vacuum chamber 15 and the support member 22.

Since a high voltage of several kV is applied to almost the entire flight tube 21, it is preferable that the support member 22 is made of, for example, a PEEK (polyetheretherketone) resin having excellent insulating properties and high mechanical stability.

Further, it is preferable that the flight tube 21 is made of highly rigid stainless steel and the vacuum chamber 15 is made of stainless steel or a lightweight metal such as aluminum. As the temperature sensors T1*a* and T1*b*, as an example, a thermistor or a resistance temperature sensor such as platinum alloy is used. Further, as the temperature adjustment elements H1*a* and H1*b*, in addition to the above-mentioned electric heater, a member capable of heating and cooling such as a Peltier element can also be used.

Power supply units 40*a* and 40*b* for respectively applying voltages to the in-vacuum electrodes are connected to the ion introduction unit 1 and the vacuum chamber (TOF section) 15. The power supply units 40*a* and 40*b* are also collectively referred to as a power supply unit 40. The power supply unit 40 includes a DC power supply applies DC voltage, an RF power supply applies AC voltage, a pulsar board as a switching board for applying pulse voltage to the extrusion electrode 17 and the extraction electrode 18, a digitizer board for digitizing the electric signal from the detector 20 and the like. These are also heat sources, and the calorific value changes depending on the operating conditions, and the temperatures of the ion introduction unit 1 and the TOF chamber 15 fluctuate.

In the TOFMS according to the present embodiment, the temperature of the support member 22 is maintained at a constant temperature by the above configuration, so that even if the temperature of the ion introduction unit 1, the temperature of the vacuum chamber 15, or the ambient temperature of the device fluctuates, it is possible to prevent the temperature of the flight tube 21 from fluctuating. As a result, expansion and contraction of the flight tube 21 can be prevented, and a time-of-flight mass spectrometry device with high measurement accuracy can be realized.

As shown in FIG. 1, in order to further suppress the inflow of heat from the ion introduction unit 1 and the heating capillary 4 which are heat sources to the flight tube 21, it is possible that at least a part of the ion introduction unit 1 is formed to contact with the device housing 14 at contact portions 13*a* and 13*b* and the portions 13*a* and 13*b* is formed of a high thermal conductive member. That is, by forming the contact portions 13*a* and 13*b* as a member having high thermal conductivity such as metal such as aluminum, the heat of the ion source (ESI spray) 3 in the ionization chamber 2 side can be dissipated to the apparatus housing 14. This makes it possible to further suppress the inflow of heat into the flight tube 21.

Further, as shown in FIG. 1, in case the ion introduction unit 1 and the heating capillary 4 are in contact with the device housing 14 at a plurality of contact portions 13*a* and 13*b* having different distances from the flight tube 21 to each other, it is preferably provided with a high thermal conductive member on the contact portion 13*a* on the side far from the flight tube, that is, on the side close to the ionization chamber 2. In this case, the contact portion 13*b* on the side closer to the flight tube 21, that is, on the side far from the ionization chamber 2, is preferably formed of a member having a low thermal conductivity (for example, PEEK resin) instead of a high thermal conductive member.

Generally, the ion introduction unit 1 and the vacuum chamber 15 are configured to be connected to the device housing 14 by a plurality of the connecting parts 13 to improve the mechanical strength of the entire device. In the TOFMS according to the present embodiment, among the plurality of connection portions 13, the connection portion located near the heat source with respect to the vacuum chamber 15 containing the flight tube 21 is to be a high thermal conductive member with relatively high thermal conductivity, and the connection portion located far from the heat source with respect to the vacuum chamber 15 (that is, a position close to the vacuum chamber 15) is to be a low heat conductive member having relatively low thermal conductivity. As a result, temperature stability of the flight tube can be improved while ensuring the desired mechanical strength.

The device housing 14 is a housing that supports at least a part of, the ion introduction unit 1 and the vacuum chamber 15, and is preferably made of metal from the viewpoint of mechanical strength, EMC (Electro Magnetic Compatibility), and thermal conductivity. It is noted that, even in case that the contact portions 13*a* and 13*b* are not formed of the high thermal conductive member, that is, even in case that the heat of the ion introduction portion 1 is not positively dissipated to the device housing 14, the temperature of the vacuum chamber 15 fluctuates due to fluctuations in the temperature around the device. Therefore, the contact portion 13*c* of the device housing 14 with the vacuum chamber 15 is preferably formed of a member (for example, PEEK resin) having a thermal conductivity lower than that of the above-mentioned high thermal conductive member. Thereby, the thermal resistance between the vacuum chamber 15 and the housing 14 increases, and even if the temperature of the vacuum chamber 15 fluctuates due to fluctuations in the temperature around the device or heat from the ion introduction unit 1, the effect of these becomes difficult to propagate to the vacuum chamber 15 and the temperature fluctuation of the flight tube can be suppressed.

In addition to the temperature sensor T1 and the temperature adjustment element H1 described above, other temperature sensor and other temperature adjustment element may be further provided on the outer surface of the vacuum chamber 15 in order to control the temperature of the flight tube 21 with higher accuracy.

As an example, as shown in FIG. 1, on the outer surface of the vacuum chamber 15 corresponding to the middle position in the Z direction of the flight tube 21, second temperature sensors T2*a*, T2*b* and second temperature adjustment elements H2*a*, H2*b* can be provided. Similarly, third temperature sensors T3*a* and T3*b* and third temperature adjustment elements H3*a* and H3*b* can be provided on the outer surface of the vacuum chamber 15 corresponding to the position near the lower end of the flight tube 21 in the Z direction.

It is preferable that the second temperature sensors T2*a* and T2*b* are provided in the vicinity of the second temperature adjustment elements H2*a* and H2*b*, respectively. Similarly, it is preferable that the third temperature sensors T3*a* and T3*b* are provided in the vicinity of the third temperature adjustment elements H3*a* and H3*b*, respectively.

Hereinafter, the temperature sensors T2*a* and T2*b* may be referred to as a temperature sensor T2 in combining them or any one of them. Further, the temperature adjustment elements H2*a* and H2*b* may be referred to as a temperature adjustment element H2 in combining them or any one of them.

Similarly, the temperature sensors T3*a*, T3*b* may be referred to as the temperature sensor T3 in combining then or any one of them. Further, the temperature adjustment elements H3*a* and H3*b* may be referred to as a temperature adjustment element H3 in combining them or any one of them.

In these examples, the second temperature sensors T2*a* and T2*b*, the second temperature adjustment elements H2*a* and H2*b*, the third temperature sensors T3*a* and T3*b*, and the third temperature adjustment elements H3*a* and H3*b* are provided at positions separated at least in the longitudinal direction of the flight tube 21 from the temperature sensor T1.

The temperatures measured by the second temperature sensors T2*a* and T2*b* and the third temperature sensors T3*a* and T3*b* are transmitted to the temperature control unit 30 as temperature measurement signals S2*a*, S2*b*, S3*a* and S3*b*. The temperature control unit 30 transmits temperature control signals C2*a*, C2*b*, C3*a*, and C3*b* to the second temperature adjustment elements H2*a*, H2*b* and the third temperature adjustment elements H3*a*, H3*b*, so that temperatures of each part of the vacuum chamber 15 in which each temperature sensors are installed is controlled to have a predetermined temperature of, for example, 35° C. or higher and 50° C. or lower as described above.

Number of each of the second temperature sensors T2, the second temperature adjustment elements H2, the third temperature sensors T3, and the third temperature adjustment elements H3 is not limited to two as shown in FIG. 1, it may be any number such as four, six, or one. Further, each temperature sensor and each temperature adjustment element do not have to have one-to-one correspondence.

Figure 3:
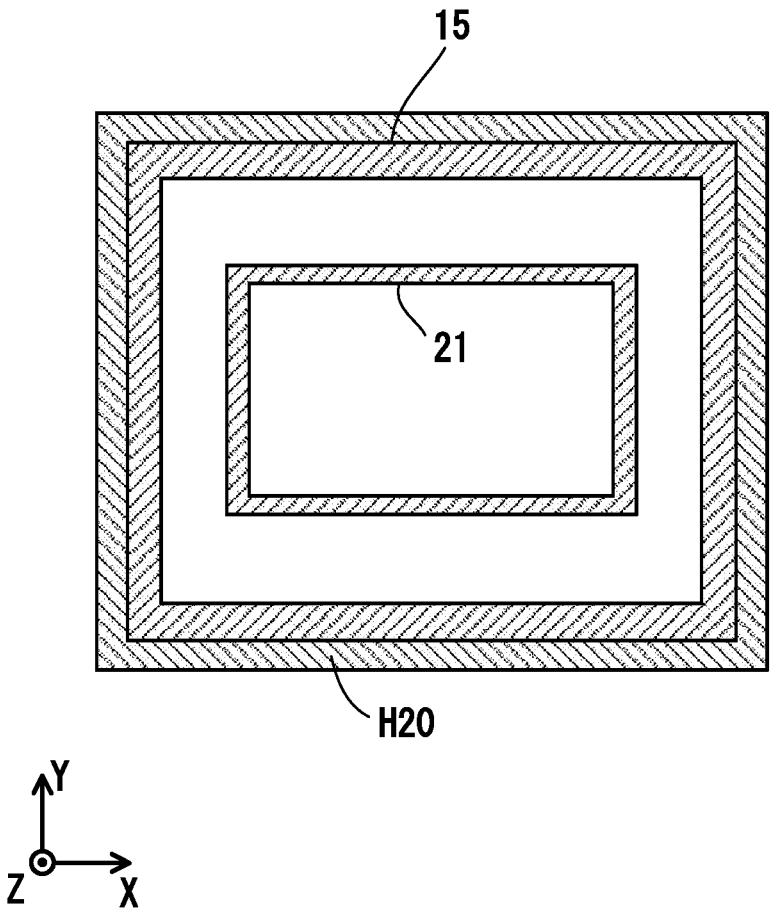
FIG. 3 is a schematic diagram showing a variation of a second temperature adjustment element.

Moreover, at least one of the second temperature adjustment element H2 or the third temperature adjustment element H3 may be a continuous temperature adjustment element H20 surrounding the outer circumference of the vacuum chamber 15 as shown in FIG. 3.

The temperature control unit 30 controls the first temperature adjustment element H1, the second temperature adjustment element H2, and a third temperature adjustment element H3 based on the measurement results of the temperature sensor T1, the second temperature sensor T2, and the third temperature sensor T3 so that each part at which each temperature adjustment element is installed in the vacuum chamber 15 has a predetermined temperature.

Since inside of the vacuum chamber 15 is maintained in high vacuum, the heat transfer from the vacuum chamber 15 to the flight tube 21 is limited to mainly heat conduction by the support member 22 or radiation heat transfer from the vacuum chamber 15 to the flight tube 21. Therefore, in order to control the temperature of the flight tube 21 with high accuracy by controlling the temperature of the vacuum chamber 15, it is preferable to improve the efficiency of radiation heat transfer from the vacuum chamber 15 to the flight tube 21.

In order to increase the efficiency of this radiation heat transfer, the inner wall surface of the vacuum chamber 15 can be surface-treated so as to increase radiation factor. Specifically, aluminum is used as the material of the vacuum chamber 15, and a coating layer 15*s* by black nickel plating can be formed on the inner wall surface of the vacuum chamber 15 at least in the range facing the flight tube 21.

As is well known, black nickel plating is one of the commonly used plating for the purposes of antireflection or decoration, and its processing cost is relatively low. By forming the coating layer 15*s* of black nickel plating, the surface becomes black and the radiation factor is improved. According to the experiment of the present inventor, it has been confirmed that the radiation factor can be increased by about 10 times by forming the coating layer 15*s* of black nickel plating on the inner wall surface of the vacuum chamber 15 made of aluminum. According to this, the thermal resistance in the path of radiation heat transfer between the vacuum chamber 15 and the flight tube 21 is significantly reduced as compared with the conventional one (in which the coating layer 15*s* of black nickel plating is not formed), and the temperature stability of the flight tube 21 can be improved.

It is to be noted that, the inner wall surface of the vacuum chamber 15 may be treated by ordinary nickel plating, or a coating layer may be formed by alumite processing. Alternatively, a coating layer capable for improving the radiation factor may be formed on the surface by a carbon film forming treatment, a ceramic spray treatment, other plating processing, a painting or coating processing, a thermal spray treatment, or the like.

Further, not forming a coating layer made of a material different from the material of the vacuum chamber 15, but the surface of the vacuum chamber 15 itself may be chemically or physically scraped to form irregularities.

Alternatively, a thin plate or thin foil of other material having a higher radiation factor than the material of the vacuum chamber 15 may be attached to the inner wall surface of the vacuum chamber 15. Specifically, a thin stainless steel plate may be attached to the inner wall surface of the above vacuum chamber 15 made of aluminum. This also increases the radiation factor of the inner wall surface of the vacuum chamber 15, so that the same effect as in the above embodiment can be achieved.

According to the above-described one embodiment, the following effects can be obtained.

(1) A time-of-flight mass spectrometry device according to one embodiment, comprises: an ion introduction unit 1; a vacuum chamber 15 connected to the ion introduction unit 1; a support member 22 provided inside the vacuum chamber 15; a flight tube 21 having a part of the outer surface supported by the support member 22 and provided inside the vacuum chamber 15; a temperature sensor T1 provided in the vicinity of a connection portion with the support member 22 of the vacuum chamber 15; a temperature adjustment element H1 provided in the vicinity of the connection portion; and a temperature control unit 30 that controls the temperature adjustment element H1 based on a measurement result of the temperature sensor T1.

With this configuration, even if the temperature of the ion introduction unit 1, the temperature of the vacuum chamber 15, the ambient temperature of the device, or the calorific value of the power supply unit 40 fluctuates, it is possible to prevent the temperature of the flight tube 21 from fluctuating. Thereby, expansion and contraction of the flight tube 21 by temperature fluctuation can be prevented, and a time-of-flight mass spectrometry device with high measurement accuracy can be realized.

(2) In the time-of-flight mass spectrometry device of above described one embodiment, the time-of-flight mass spectrometry device comprises a plurality of the support members 22, wherein: the temperature sensor T1 and the temperature adjustment element H1 are provided in the vicinity of a plurality of the connection portions connected to the support members 22 in the vacuum chamber 15. Thereby, it is possible to further prevent temperature of the flight tube 21 from fluctuating and a time-of-flight mass spectrometry device with high measurement accuracy can be realized.

(3) The time-of-flight mass spectrometry device in above described (2), wherein: a plurality of the support members 22 are arranged on a plane orthogonal to the longitudinal direction of the flight tube 21 or in the vicinity of the plane. Thereby, it is possible to further prevent the flight tube 21 from fluctuating and a time-of-flight mass spectrometry device with further high measurement accuracy can be realized.

(4) The time-of-flight mass spectrometry device in above described (3), further comprises: a second temperature sensor T2 and a second temperature adjustment element H2 provided on the outer surface of the vacuum chamber 15 and at positions separated at least in the longitudinal direction of the flight tube 21 from the temperature sensor T1, wherein: the temperature control unit 30 controls the second temperature adjustment element H2 based on a measurement result of the second temperature sensor T2. Thereby, it is possible to further prevent temperature of the flight tube 21 from fluctuating and a time-of-flight mass spectrometry device with further high measurement accuracy can be realized. It is to be noted that, the first temperature control unit H1 or the second temperature control unit H2 may be controlled based on the measurement results of both the second temperature sensor T2 and the first temperature sensor T1.

(5) The time-of-flight mass spectrometry device of above described (4), further comprised: a third temperature sensor T3 and a third temperature adjustment element H3 provided on the outer surface of the vacuum chamber 15 and at positions separated at least in the longitudinal direction of the flight tube 21 from the second temperature sensor T2, wherein: the temperature control unit 30 controls the third temperature adjustment element H3 based on a measurement result of the third temperature sensor T3. Thereby, it is possible to further prevent temperature of the flight tube 21 from fluctuating and a time-of-flight mass spectrometry device with further high measurement accuracy can be realized. It is to be noted that, any of the first temperature control unit H1, the second temperature control unit H2 and the third temperature control unit H3 may be controlled based on a plurality of measurement results from among of the first temperature sensor T1, the second temperature sensor T2 and the third temperature sensor T3.

(6) In the time-of-flight mass spectrometry device of above described one embodiment, wherein: an inner wall surface of the vacuum chamber 15 facing the flight tube 21 is subjected to radiation factor improvement treatment. Thereby, it is possible to further prevent temperature of the flight tube 21 from fluctuating and a time-of-flight mass spectrometry device with further high measurement accuracy can be realized. Further, the temperature stabilization time of the flight tube is shortened, the time until the measurement can be started when the device is started is shortened, and the time-of-flight mass spectrometer with high measurement efficiency can be realized.

(7) In the time-of-flight mass spectrometry device of above described one embodiment, wherein: the ion introduction unit 1 has contact portions 13*a*, 13*b* with the device housing 14, and the ion introduction unit 1 is in thermal contact with the device housing 14 via the high thermal conductive members 13*a*, 13*b* at at least a part of the contact portions 13*a*, 13*b*. Thereby, the heat conducted from the ion introduction unit 1 to the flight tube 21 can be reduced, and the temperature fluctuation of the flight tube 21 can be further prevented.

(8) The time-of-flight mass spectrometry device of above described (7), wherein: the contact portions 13*a*, 13*b* are a plurality of locations having different distances from the flight tube 21, and the high thermal conductive member 13*a* is provided on a contact portion 13*a* among a plurality of the contact portions 13*a*, 13*b* that is far from the flight tube 21. Thereby, the heat conducted from the ion introduction unit 1 to the flight tube 21 can be reduced, and the temperature fluctuation of the flight tube 21 can be further prevented.

(9) The time-of-flight mass spectrometry device of above described (1) through (8), wherein: the vacuum chamber 15 has the second contact portion 13*c* that contacts with the device housing 14, and the vacuum chamber 15 is in thermal contact with the device housing 14 via the low heat conductive member 13*c*. Thereby, the heat conducted from the device housing 14 to the flight tube 21 can be reduced, and the temperature fluctuation of the flight tube 21 can be further prevented.

The present invention is not limited to the contents of the above embodiments. Other modes that are conceivable within the scope of the technical idea of the present invention are also included within the scope of the present invention.

The above embodiment is according to the reflectron-type TOFMS of the orthogonal acceleration type, however it does not necessary have to be the orthogonal acceleration type. It may have, for example, a configuration in which ions emitted from an ion trap are introduced into the flight space, or in which ions generated from a sample by a MALDI ion source are accelerated and put into the flight space. Further, not a reflectron-type but a linear type TOFMS may be used.

REFERENCE SIGNS LIST

100 . . . Time-of-flight Mass Spectrometry Device, 1 . . . Ion Introduction Unit, 2 . . . Ionization Chamber, 3 . . . ESI Spray, 4 . . . Heating Capillary, 5, 7, 11 . . . Ion Guide, 6 . . . Skimmer, 8 . . . Quadrupole Mass Filter, 9*a* . . . Inlet Lens Electrode, 9*b* . . . Exit Lens Electrode, 10 . . . Collision Cell, 12 . . . Ion Transport Optical System, 13*a*, 13*b* . . . Contact Portion, 13*c* . . . Second Contact Portion, 14 . . . Housing, 15 . . . Vacuum Chamber (TOF Section), 16 . . . Orthogonal Acceleration Unit, 17 . . . Extrusion Electrode, 18 . . . Extraction Electrode, FA . . . Flight Space, FP . . . Flight Path, 19 . . . Reflector, 20 . . . Ion Detector, 21 . . . Flight Tube, 22 . . . Support Member, 30 . . . Temperature Control Unit, H1*a*, H1*b*, H1*c*, H1*d* . . . Temperature Adjustment Element, H2*a*, H2*b* . . . Second Temperature Adjustment Element, H3*a*, H3*b* . . . Third Temperature Adjustment Element, T1*a*, T1*b*, T1*c*, T1*d* . . . Temperature Sensor, T2*a*, T2*b* . . . Second Temperature Sensor, T3*a*, T3*b* . . . Third Temperature Sensor, 40 . . . Power Supply Unit

The invention claimed is:

1. A time-of-flight mass spectrometry device, comprising:
an ion introducer;
a vacuum chamber having an outer surface and an inner surface and connected to the ion introducer;
a flight tube provided within the vacuum chamber;
a support member that supports the flight tube within the vacuum chamber, wherein the support member is in contact with the flight tube and the inner surface of the vacuum chamber;
a temperature sensor provided in the vicinity of a contact part between the vacuum chamber and the support member and on a side of the outer surface of the vacuum chamber;
a temperature adjuster provided in the vicinity of the contact part and on the side of the outer surface of the vacuum chamber; and
a temperature controller that controls the temperature adjuster based on a measurement result of the temperature sensor.

2. The time-of-flight mass spectrometry device according to claim 1, comprising:
a plurality of the support members; and
a plurality of the contact parts each connected to one of the support members, wherein:
the temperature sensor and the temperature adjuster are provided in the vicinity of a plurality of the contact parts connected to the support members in the vacuum chamber.

3. The time-of-flight mass spectrometry device according to claim 2, wherein:
the plurality of the support members are arranged on a plane orthogonal to a longitudinal direction of the flight tube or in the vicinity of the plane.

4. The time-of-flight mass spectrometry device according to claim 3, further comprising:
a second temperature sensor and a second temperature adjuster provided on the outer surface of the vacuum chamber and at positions separated at least in the longitudinal direction of the flight tube from the temperature sensor, wherein:
the temperature controller controls the second temperature adjuster based on a measurement result of the second temperature sensor.

5. The time-of-flight mass spectrometry device according to claim 4, further comprising:
a third temperature sensor and a third temperature adjuster provided on the outer surface of the vacuum chamber and at positions separated at least in the longitudinal direction of the flight tube from the second temperature sensor, wherein:
the temperature controller controls the third temperature adjuster based on a measurement result of the third temperature sensor.

6. The time-of-flight mass spectrometry device according to claim 1, wherein:
an inner wall surface of the vacuum chamber facing the flight tube is subjected to radiation factor improvement treatment.

7. The time-of-flight mass spectrometry device according to claim 6, wherein:
the ion introducer has a contact portion with a device housing, and the ion introducer is in thermal contact with the device housing via a high thermal conductive member that has a high thermal conductivity at at least a part of the contact portion.

8. The time-of-flight mass spectrometry device according to claim 1, wherein:
the ion introducer has a contact portion with a device housing, and the ion introducer is in thermal contact with the device housing via a high thermal conductive member that has a high thermal conductivity at at least a part of the contact portion.

9. The time-of-flight mass spectrometry device according to claim 8, wherein:
the contact portion includes a plurality of contact portions,
the contact portions are a plurality of locations having different distances from the flight tube, and
the high thermal conductive member is provided on a contact portion among a plurality of the contact portions that is far from the flight tube.

10. The time-of-flight mass spectrometry device according to claim 1, wherein:
the vacuum chamber has a second contact portion that contacts with a device housing, and the vacuum chamber is in thermal contact with the device housing via a low heat conductive member that has a low thermal conductivity at at least a part of the second contact portion.

11. The time-of-flight mass spectrometry device according to claim 6, wherein:
the vacuum chamber has a second contact portion that contacts with a device housing, and the vacuum chamber is in thermal contact with the device housing via a low heat conductive member that has a low thermal conductivity at at least a part of the second contact portion.

12. The time-of-flight mass spectrometry device according to claim 7, wherein:

the vacuum chamber has a second contact portion that contacts with the device housing, and the vacuum chamber is in thermal contact with the device housing via a low heat conductive member that has a low thermal conductivity at at least a part of the second contact portion.

13. The time-of-flight mass spectrometry device according to claim 8, wherein:

the vacuum chamber has a second contact portion that contacts with the device housing, and the vacuum chamber is in thermal contact with the device housing via a low heat conductive member that has a low thermal conductivity at at least a part of the second contact portion.

* * * * *